US008205761B2

(12) United States Patent
Stull, Sr. et al.

(10) Patent No.: US 8,205,761 B2
(45) Date of Patent: Jun. 26, 2012

(54) LIGHTWEIGHT CHILD-RESISTANT CLOSURE

(75) Inventors: Gene Stull, Sr., Far Hills, NJ (US); Robert T. Auer, East Stroudsburg, PA (US)

(73) Assignee: Stull Technologies, Inc., Somerset, NJ (US)

( * ) Notice: Subject to any disclaimer, the term of this patent is extended or adjusted under 35 U.S.C. 154(b) by 276 days.

(21) Appl. No.: 12/625,997

(22) Filed: Nov. 25, 2009

(65) Prior Publication Data

US 2010/0126997 A1 May 27, 2010

Related U.S. Application Data

(60) Provisional application No. 61/200,148, filed on Nov. 25, 2009.

(51) Int. Cl.
*B65D 55/02* (2006.01)

(52) U.S. Cl. ..... 215/220

(58) Field of Classification Search ..... 215/217, 215/219, 220

See application file for complete search history.

(56) References Cited

U.S. PATENT DOCUMENTS

| | | | | |
|---|---|---|---|---|
| 3,027,035 | A | | 3/1962 | Farago |
| 3,679,085 | A | | 7/1972 | Gach |
| 3,685,676 | A | | 8/1972 | Gach et al. |
| 3,722,727 | A | | 3/1973 | Gach |
| 3,843,006 | A | | 10/1974 | Naito et al. |
| 3,888,375 | A | * | 6/1975 | Gerk ..... 215/219 |
| 3,912,101 | A | | 10/1975 | Rayner et al. |
| 3,915,326 | A | * | 10/1975 | Hrubesky ..... 215/219 |
| 3,944,102 | A | | 3/1976 | Grau |
| 3,946,889 | A | | 3/1976 | Gach |
| 3,989,153 | A | | 11/1976 | McRoskey et al. |
| 4,069,935 | A | | 1/1978 | Hampel |
| 4,364,484 | A | | 12/1982 | Kinsley |
| 4,365,722 | A | | 12/1982 | Kramer |
| 4,480,759 | A | | 11/1984 | Behrens et al. |

(Continued)

FOREIGN PATENT DOCUMENTS

GB 2 138 410 10/1984

(Continued)

OTHER PUBLICATIONS

European Search Report for EP10191842.3, dated Feb. 18, 2011, 5 pages.

*Primary Examiner* — Anthony Stashick
*Assistant Examiner* — James N Smalley
(74) *Attorney, Agent, or Firm* — Drinker Biddle & Reath LLP

(57) ABSTRACT

A child-resistant container closure includes a base cap having a top, a skirt, and a plurality of asymmetric teeth recessed in the skirt below the top, and a cover cap having a top, a skirt, and a plurality of asymmetric downwardly extending teeth adjacent to the skirt, the teeth being adapted for asymmetric engagement with the base cap teeth, the skirt having a plurality of interspersed vertical legs each spaced apart from adjacent legs by vertical openings, the legs being joined at a bottom end of the skirt by a support ring, the base cap teeth each having a sloped sliding face to ensure that one of the cover cap teeth will drop into a notch between adjacent base cap teeth when the cover cap is rotated in one direction.

19 Claims, 3 Drawing Sheets

U.S. PATENT DOCUMENTS

| | | | | |
|---|---|---|---|---|
| 4,489,834 | A | 12/1984 | Thackrey | |
| 4,526,293 | A | 7/1985 | Kramer | |
| 4,562,933 | A | 1/1986 | Dennis | |
| 4,669,620 | A | 6/1987 | Coifman | |
| D298,608 | S | 11/1988 | Dewing | D9/452 |
| 4,832,218 | A | 5/1989 | Gibilisco | |
| D311,868 | S | 11/1990 | Armstrong | D9/453 |
| 5,005,718 | A | 4/1991 | Buono | |
| 5,115,929 | A | 5/1992 | Buono | |
| D327,849 | S | 7/1992 | Armstrong | D9/453 |
| 5,197,616 | A | 3/1993 | Buono | |
| 5,213,223 | A | 5/1993 | Minnette | |
| D356,871 | S | 3/1995 | Dunn | D24/197 |
| 5,398,829 | A | 3/1995 | Stubbs | |
| 5,433,329 | A | 7/1995 | Weinstein | |
| D372,867 | S | 8/1996 | Lambelet | D9/456 |
| 5,579,934 | A | 12/1996 | Buono | |
| 5,676,268 | A | 10/1997 | King | |
| 5,893,473 | A | 4/1999 | Morris, Sr. | |
| 5,908,125 | A | 6/1999 | Opresco | |
| 5,915,576 | A | 6/1999 | Robinson | |
| 5,938,055 | A | 8/1999 | Philips et al. | |
| 5,941,402 | A | 8/1999 | Krueger | |
| D422,217 | S | 4/2000 | Gundlach et al. | |
| 6,085,920 | A | 7/2000 | Moretti | |
| D442,089 | S | 5/2001 | Sadeghi et al. | D9/452 |
| D443,513 | S | 6/2001 | Goettner | D9/452 |
| D445,679 | S | 7/2001 | Malmborg | |
| 6,296,130 | B1 | 10/2001 | Forsyth et al. | |
| D449,991 | S | 11/2001 | King | |
| 6,382,440 | B1 | 5/2002 | Brant et al. | |
| D464,434 | S | 10/2002 | Morano | D24/197 |
| D480,644 | S | 10/2003 | Druitt | |
| D481,946 | S | 11/2003 | Nicholson et al. | |
| 6,789,497 | B1 | 9/2004 | Aiken | 116/308 |
| D510,523 | S | 10/2005 | Pitman et al. | |
| 7,000,789 | B2 | 2/2006 | Miceli et al. | |
| D544,348 | S | 6/2007 | Szczesniak | |
| D544,959 | S | 6/2007 | Sudo | |
| D561,587 | S | 2/2008 | Lin | |
| D563,560 | S | 3/2008 | Copeland | D24/224 |
| D574,239 | S | 8/2008 | Lin | |
| D578,889 | S | 10/2008 | Sadiq | |
| D592,954 | S | 5/2009 | Capretta et al. | D9/453 |
| 2002/0162817 | A1 | 11/2002 | Vassallo | |
| 2004/0011759 | A1 | 1/2004 | Hahn et al. | |
| 2008/0173609 | A1 | 7/2008 | Shingle | |

FOREIGN PATENT DOCUMENTS

| | | |
|---|---|---|
| WO | WO 90/01451 | 2/1990 |
| WO | WO 95/03228 | 2/1995 |
| WO | WO 98/22362 | 5/1998 |

* cited by examiner

LIGHTWEIGHT CHILD-RESISTANT CLOSURE

RELATED APPLICATION

This application is claims priority from U.S. Provisional Application No. 61/200,148, filed Nov. 25, 2008, which is incorporated herein by reference in its entirety.

TECHNICAL FIELD

The application relates to a lightweight container closure or cap, and in particular to a container closure having a child-resistant safety feature to inhibit opening of the container by a child.

BACKGROUND

Child-resistant container closures are known in the art. Such closures typically have a nested two-cap construction, including a base cap for sealing a container opening and a cover cap that captures the base cap. The base cap threads onto a neck of the container about the opening. Cooperating features disposed on an inner portion of the cover cap and an outer portion of the base cap enable selective engagement between the base cap and the cover cap, such that a single rotational action is sufficient to install the closure onto the container while a combined rotational and pushing and/or squeezing action is required to remove the closure from the container. In practice, when the cover cap is rotated in a first direction so as to thread the base cap onto the container neck, the cover cap and the base cap reliable engage and rotate in tandem, but when the cover cap is rotated in second a direction so as to unthread the base cap from the container neck, the cover cap must be further manipulated (e.g., by pushing downward on the cover cap or squeezing a portion of the cover cap while rotating) to cause the base cap to rotate in tandem with the cover cap. If the cover cap is rotated in the second direction without further manipulating the cover cap, the closure the closure will not open the container.

SUMMARY

In one embodiment, a child-resistant container closure includes a base cap and a cover cap. The base cap has a top and a skirt depending downwardly from the top, the skirt including a plurality of formed in an outer wall of the skirt below the top, internal threads for engaging a neck of the container, and a bottom end. The cover cap has a top with a central opening and a skirt depending downwardly from the top, the top including a plurality of asymmetric downwardly extending teeth adjacent to the skirt, the skirt having a plurality of interspersed vertical legs each spaced apart from adjacent legs by vertical openings, the legs being joined at or near a bottom end of the skirt by a support ring. The cover cap teeth are adapted for engagement with the base cap teeth. When the cover cap is rotated in a first (locking) direction, the cover cap teeth engage the base cap teeth to cause the base cap to rotate along with the cover cap in a direction to tighten the base cap onto a container. When the cover cap is rotated in a second (opening) direction in combination with a predetermined downward force urging the cover cap top toward the base cap top, the cover cap teeth engage the base cap teeth to cause the base cap to rotate along with the cover cap in a direction to loosen the base cap from the container. The base cap teeth each have a sloped sliding face to ensure that one of the cover cap teeth will drop into a notch between adjacent base cap teeth when the cover cap is rotated in the second direction. When the cover cap is rotated in the second direction in the absence of the predetermined downward force, the base cap remains nonrotating and the cover cap teeth slide over the base cap teeth causing an audible clicking sound as pairs of teeth jump from one sliding engagement to another.

In another embodiment, a child-resistant container closure includes a base cap and a cover cap. The base cap has a top and a skirt depending downwardly from the top, the skirt including a plurality of asymmetric teeth recessed below the top, internal threads for engaging a neck of the container, and a bottom end. Each of the base cap teeth has a closing face sloped about 20 degrees from vertical, an opening face sloped about 30 degrees from vertical, and a sliding face disposed between the closing face and the sliding face and sloped about 6 degrees from horizontal, a junction between the closing face and the sliding face being disposed above a junction between the opening face and the sliding face. The cover cap has a top with an central opening and a skirt depending downwardly from the top, the top including a plurality of asymmetrical downwardly extending teeth adapted for engagement with the base cap teeth, the skirt having bottom end, an inwardly protruding raised ridge for centering the cover, cap on the base cap, and a support ring protruding radially inwardly from the bottom end to engage with a ridge protruding radially outwardly from the bottom end of the base cap skirt to inhibit removal of the cover cap from the base cap. Each of the cover cap teeth has a closing face sloped about vertical, an opening face sloped about 45 degrees from vertical, and a sliding face disposed between the closing face and the sliding face and sloped about horizontal. When the cover cap is rotated in a first (locking) direction, the cover cap teeth engage the base cap teeth to cause the base cap to rotate along with the cover cap in the first direction to tighten the base cap onto a container. When the cover cap is rotated in a second direction in combination with a predetermined downward force urging the cover cap top toward the base cap top, the cover cap teeth engage the base cap teeth to cause the base cap to rotate along with the cover cap in the second direction to loosen the base cap from the container. The slope of the sliding faces of the base cap teeth ensures that one of the cover cap teeth will drop into a notch between adjacent base cap teeth when the cover cap is rotated in the second direction. When the cover cap is rotated in the second direction in the absence of the predetermined downward force, base cap remains nonrotating and the cover cap teeth slide over the base cap teeth causing an audible clicking sound as pairs of teeth jump from one sliding engagement to another.

BRIEF DESCRIPTION OF THE DRAWINGS

The above and other aspects, features and advantages of the present invention will be more apparent from the following more particular description thereof, presented in conjunction with the following drawings wherein.

Figure 1:
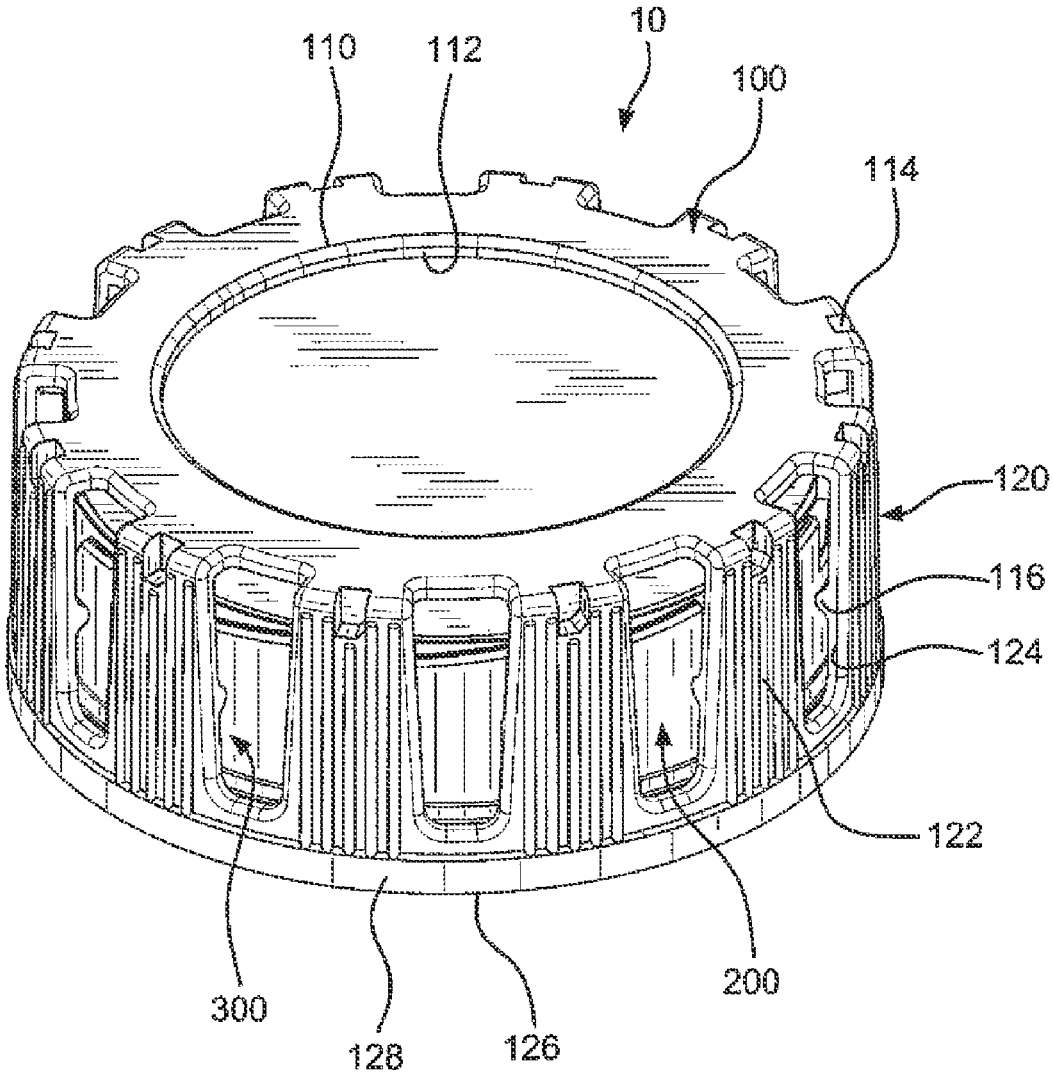
FIG. 1 is a top perspective view of a closure showing a base cap captured within a cover cap.
Figure 4:
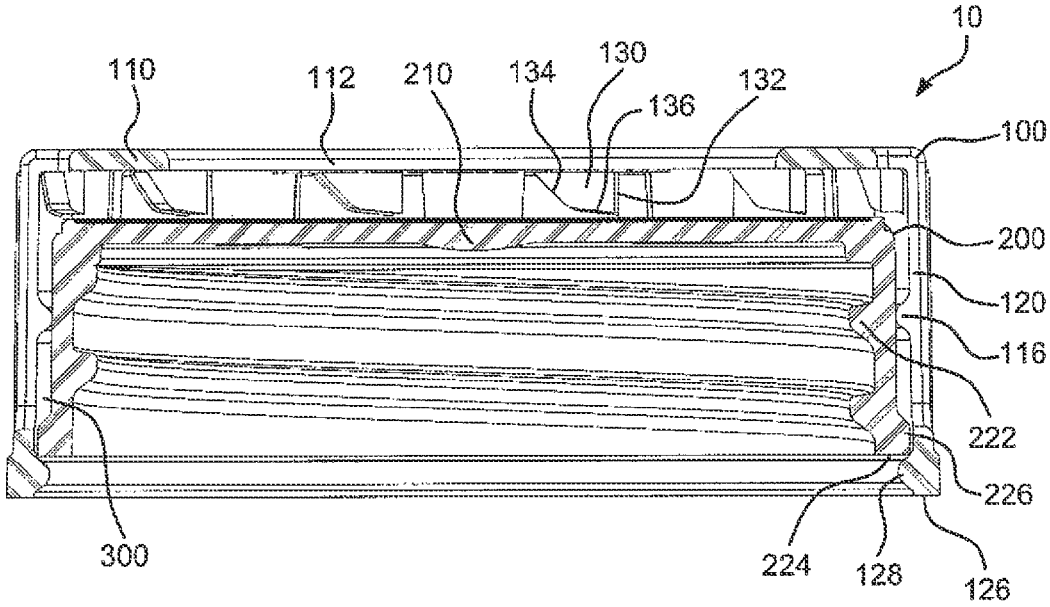
FIG. 4 is a side cross-sectional view of the closure of FIG. 1.

DETAILED DESCRIPTION:

Referring to FIGS. 1 and 4, an embodiment of a child-resistant container closure 10 is depicted. The closure 10 is a two-piece device including a cover cap 100 and a base cap 200. The base cap 200 is designed to seal a container opening by threading onto a neck of the container. The cover cap 100 is designed to snap around and capture the base cap 200, as depicted in FIGS. 1 and 4, and as is described in detail below.

Figure 2:
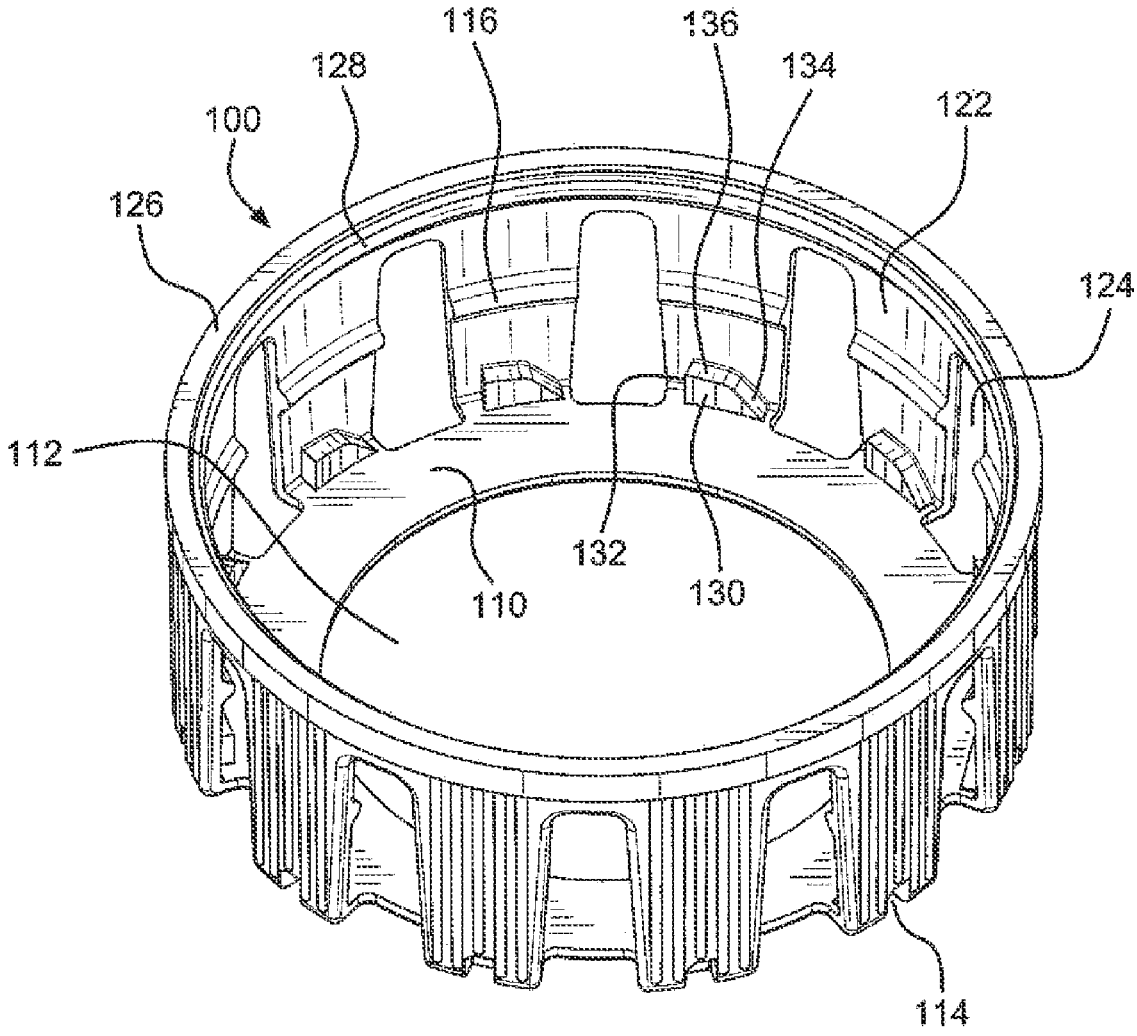
FIG. 2 is a bottom perspective view of the cover cap of FIG. 1.

With particular reference to FIG. 2, the cover cap 100 includes a top 110 and a skirt 120 depending downwardly from a periphery of the top 110. The top 110 has a centrally disposed opening 112 to reduce the amount of material required to make the cover cap 100, which also reduces the shipping weight of the closure 10. The skirt 120 extends from a top end adjoining the top 110 to a bottom end 126. The skirt 120 has a plurality of interspersed vertical legs 122 and vertical cut-outs or openings 124. The legs 122 and the openings 124 preferably alternate in a regular pattern and the legs 122 are preferably joined together at a bottom end 126 of the skirt 120 by a support ring 128. The support ring 128 provides rigidity to the skirt 120 while the openings 124 enable the skirt 120 to be lighter in weight and to use less material than a conventional solid skirt. The skirt 120 further includes an inwardly protruding raised ridge 116 on each of the legs 122 to center the cover cap 100 on the base cap 200. Among other benefits, the interspersed legs 122 and slots 124 provide a good gripping surface for a user, particularly for a user with arthritis, advanced age, or other condition that limits gripping strength.

Figure 3:
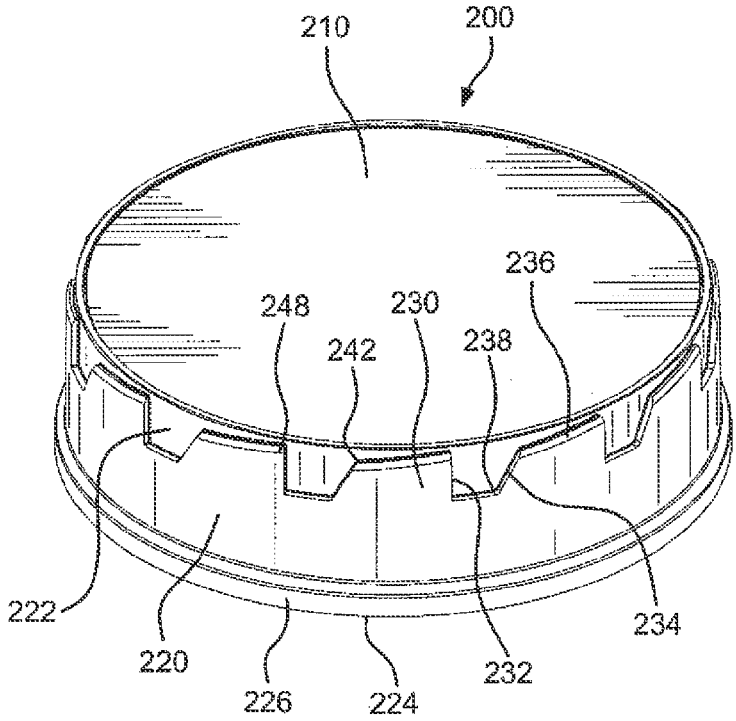
FIG. 3 is a top perspective view of the base cap of FIG. 1.

With particular reference to FIG. 3, the base cap 200 includes a top 210 and a skirt 220 depending downwardly from a periphery of the top 210. The skirt 220 extends from a top end adjoining the top 210 to a bottom end 224. Internal threads 222 protrude inwardly from the skirt 220 for engagement with a container neck. The base cap 200 has an outer diameter and the cover cap 100 has an inner diameter, the outer diameter of the base cap 200 being sufficiently smaller than the inner diameter of the cover cap 100 to create an annular gap 300, as shown in FIG. 4. The raised ridge 116 on each of the legs 122 is sized to be slightly smaller than the annular gap 300 to center the cover cap 100 on the base cap 200 while still allowing the cover cap 100 to rotate freely about the base cap 200 with minimal frictional interference with the base cap 200, such that contact between the raised ridges 116 and the base cap skirt 220 does not provide enough friction by itself to cause the base cap 200 to rotated when the cover cap 100 is rotated.

As shown in FIGS. 2 and 4, a plurality of cover cap teeth 130 extend downwardly from the top 110 of the cover cap 100 adjacent to and preferably formed integrally with the skirt 120. The teeth 130 are circumferentially spaced apart at a regular spacing distance. As shown, each tooth 130 is preferably formed on an inside surface of a leg 122, thus helping to stiffen the leg 122 when it attaches to the top 110. Each tooth 130 is shaped with an asymmetric bias, having a sliding face 136, a closing face 132 disposed on one side of the sliding face 136, and an opening face 134 disposed on an opposite side of the sliding face 136. A junction between the closing face 132 and the sliding face 136 forms a right angle or an obtuse angle, and a junction between the opening face 134 and the sliding face 136 forms an obtuse angle. The sliding face 136 is preferably sloped in a range of about horizontal to about 5 degrees from horizontal, sloping downward from the junction with the closing face 132 to the junction with the opening face 134. In the depicted embodiment, the sliding face 136 is disposed at about horizontal. The closing face 132 is preferably sloped in a range of about vertical to about 10 degrees from vertical. In the depicted embodiment, the closing face 132 is about vertical. The opening face 134 is preferably sloped in a range of about 35 degrees to about 55 degrees from vertical. In the depicted embodiment, the opening face 134 is sloped at about 45 degrees from vertical. To save material and weight of manufacture, and to improve the ability of the cover cap 100 to be injection molded out of plastic, each cover cap tooth 130 can include a recessed rear notch 114.

As shown in FIG. 3, a plurality of base cap teeth 230 are formed in an outer wall of the skirt 220 of the base cap 200, the teeth 230 and are preferably located below the top 210. A portion 222 of the skirt 220 is recessed from the teeth 230. The teeth 230 are circumferentially spaced apart at a substantially equal distance, the positioning of the teeth 230 of the base cap 200 substantially corresponding to the positioning of the teeth 130 of the cover cap 100 to enable engagement or meshing between the teeth 130, 230. The number of teeth 130 and the number of teeth 230 need not be the same, but are preferably multiples of each other. As shown, there are twelve teeth 130 and twelve teeth 230, so that when the teeth are able to engage, the cover cap 100 can be rotated no more than about 30 degrees (or one-twelfth of a rotation) relative to the base cap before engaging the base cap 200. Note that even if only one of the sets of teeth has twelve teeth and the other set of teeth has an even fraction of twelve teeth (e.g., two, three, four, or six teeth), the same amount of free play would be achieved, but the engagement force would be spread across less pairs of meshing teeth 130, 230. Accordingly, the number of teeth 130 and the number of teeth 230 can be selected to achieve the desired amount of free play between the cover cap 100 and the base cap 200 and the required engagement force between the sets of teeth 130, 230.

As shown particularly in FIG. 3, each base cap tooth 230 is shaped with an asymmetric bias, having a sliding face 236, a closing face 232 rising from a base 238 and disposed on one side of the sliding face 236, and an opening face 234 rising from an adjacent base 238 and disposed on an opposite side of the sliding face 236. A junction between the closing face 232 and the sliding face 236 forms a right angle or an obtuse angle, and a junction between the opening face 234 and the sliding face 236 preferably forms an obtuse angle. The sliding face 236 can be sloped in a range of about 2 degrees to about 10 degrees from horizontal, sloping downward from an apex 248 at the junction with the closing face 232 to a lower apex 242 at the junction with the opening face 234. In the depicted embodiment, the sliding face 236 is disposed at about 6 degrees from horizontal. The closing face 232 can be sloped in a range of about vertical to about 20 degrees from vertical. In the depicted embodiment, the closing face 232 is at about 20 degrees from vertical. The opening face 234 can be sloped in the range of about 20 degrees to about 45 degrees from vertical. In the depicted embodiment, the opening face 234 is sloped at about 30 degrees from vertical. As shown, the base cap teeth 230 are preferably recessed into the outer wall of the base cap skirt 220.

The asymmetry of the cover cap teeth 130 and the base cap teeth 230 enables the teeth 130, 230 to engage more positively in a first, tightening or closing direction of rotation (typically clockwise for right-handed threads) than in a second, loosening or opening direction of rotation (typically counter-clockwise for right-handed threads). In particular, because a purpose of the closure 10 is to inhibit opening thereof by a child, the teeth 130, 230 engage in a way so as to bias the closure 10 to be closed with ease but opened with more difficulty, the closing operation requiring mere turning of the cover cap 100 in the first direction whereas the opening requiring a combination of urging the cover cap 100 downward toward the base cap 200 with a predetermined force and simultaneously rotating the cover cap 100 in the second direction.

To enhance the engagement between the teeth 130, 230 for closing the closure 10, the closing face 232 of the base cap teeth 230 can be undercut with respect to the base cap skirt 220, and the closing face 132 of the cover cap teeth 130 can be undercut with respect to the cover cap skirt 120. Accordingly, when the undercut faces 132 and 232 engage with each other, the rotational force applied to the cover cap 100 is partially directed to drawing the cover cap skirt 120 toward the base cap skirt 220, and the undercut cases 132, 232 are substantially locked together to inhibit jumping or stripping of the teeth 132, 232 during rotation.

When the cover cap 100 is rotated in the first or tightening direction of rotation, the closing face 132 of the cover cap tooth 130 drops into the recess defined by the shape of the base cap teeth 230 and comes into contact and engages with the closing face 232 of the base cap tooth 230 in a manner that substantially prevents further rotation of the cover cap 100 with respect to the base cap 200. The sloped sliding face 236 of the base cap tooth 230 ensures that the tooth 130 will drop into a notch between adjacent teeth 230 and that the closing faces 132, 232 of the respective teeth 130, 230 will engage, even if the speed of rotation of the cover cap 100 is fast. Without a sloped sliding face 236, it is possible that the teeth 130, 230 could skip or jump over each other without engaging when the cover cap 100 is rotated quickly in the first direction.

As long as the threads 222 of the base cap 100 are not fully and tightly engaged with corresponding threads on the container neck, further rotation of the cover cap 100 in the first direction will cause the base cap 200 to rotate along with the cover cap 100 in the first direction. Once the threads 222 of the base cap 100 become fully engaged with the corresponding threads on the container neck, the teeth 130, 230 remain engaged to tighten the threaded engagement to secure the closure 10 on the container sufficiently to prevent accidental or inadvertent loosening of the closure 10. It is well within the knowledge of a typical user of container closures 10 to estimate the amount of tightening that is sufficient.

When the cover cap 100 is rotated in the second or loosening direction of rotation, the opening face 134 of the tooth 130 comes into contact with the opening face 234 of the tooth 230 and the opening faces 134, 234 frictionally and slidably engage with each other.

If a predetermined force is applied to urge the cover cap 100 toward the base cap 200, the frictional engagement dominates the sliding engagement and the teeth 130, 230 become positively enmeshed so that the based cap 200 rotates in the second direction along with the cover cap 100.

When the closure 10 is in a fully tightened state on the container, if a predetermined force is not applied to urge the cover cap 100 toward the base cap 200, the sliding engagement dominates the frictional engagement and the opening faces 134, 234 eventually slide completely over each other, at which point the sliding faces 136, 236 come into contact with and slide over each other, thereby releasing the engagement of the teeth 130, 230 until a subsequent engagement of teeth 130, 230 occurs upon further rotation of the cover cap 100. The repeated sliding engagement and release of the teeth 130, 230 occurs as long as the cover cap 100 is rotated in the second direction in the absence of the predetermined force urging the cover cap 100 in the direction of the base cap 200. This safety feature prevents the closure 10 from being opened by the mere turning of the cover cap 100 in the second direction but enables the closure 10 to be opened by a combination of simultaneously turning the cover cap 100 in the second direction while urging the cover cap 100 toward the base cap 200 with the predetermined force. Once the base cap 200 is loose or has been dislodged from a fully tightened state with respect to the container neck, the frictional interaction between the opening faces 134, 234 may be sufficient that the base cap 200 continues to rotate in the second direction along with the cover cap 100 even if the predetermined force is not applied to urge the cover cap 100 toward the base cap 200.

When the closure 10 is sufficiently tightened on the container as described above and the cover cap 100 is turned in the second direction without the predetermined force being applied, such that the teeth 130, 230 repeatedly come into contact with and disengage from each other, an audible clicking sound is emitted each time the teeth 130, 230 jump into a new contact between the opening faces 134, 234. The audible clicking sound serves two purposes. First, it reminds a user that the closure 10 is a child-resistant cap and that a more complex pushing and rotating action is required to open the closure 10. Second, it provides an audible alert to an adult in the event a child is attempting to open the closure 10. A particular advantage of the closure 10 is that the openings 124 in the skirt 120 and the opening 112 in the top 110 permit the clicking sound made by the releasing of the teeth 130, 230 from each other to more readily escape from within the cover cap 100, thereby making the sound louder and more audible by a user or an adult responsible for the safety of a child.

The cover cap 100 and the base cap 200 are held together to form the closure 10, such that the cover cap 100 is rotatable with respect to the base cap 200 but the cover cap 100 is not readily removable from the base cap 200. Capturing the base cap 200 within the cover cap 100 in this manner prevents a child from circumventing the safety features of the closure 10 by simply removing the cover cap 100 to directly rotate the base cap 200. In the embodiment of the closure 10 as shown particularly in FIGS. 1 and 4, a rim on the cover cap support ring 128 protrudes radially inwardly from the bottom end 126 of the skirt 120 to bridge the gap 300, such that when the cover cap 100 is installed over the base cap 200, the support ring 128 is beneath the bottom end 224 of the base cap skirt 220. Therefore, if a user or a child attempts to lift the cover cap 100 off of the base cap 200, the support ring 128 will contact the bottom end 224 of the base cap skirt 220 and prevent removal of the cover cap 100. It is understood, however, that the cover cap skirt 120 and the support ring 128, as well as the base cap skirt 220, are sufficiently flexible that if a large enough force and/or a skewed for& is applied when attempting to lift the cover cap 100, the cover cap 100 can be forcibly removed from the base cap 200. To further inhibit the removal of the cover cap 100 from the base cap 200, the bottom end 224 of the base cap skirt 200 can also include a raised ridge 226 protruding outwardly therefrom for engagement with the support ring 128.

As a further safety feature, the openings 124 in the cover cap skirt 120 can be sized to be sufficiently small so as to prevent a child's fingers from directly accessing and turning the base cap 200 without having to rely on the engagement between the cover cap 100 and the base cap 200 to open the closure 10.

Although specific embodiments have been described, the skilled artisan will understand how various modifications may be made within the scope of the present invention, which is defined by the attached claims.

The invention claimed is:

1. A child-resistant container closure comprising:

a base cap having a top and a skirt depending downwardly from the top, the skirt including a plurality of asymmetric teeth recessed below the top, internal threads for engaging a neck of the container, and a bottom end; and a cover cap having a top and a skirt depending downwardly from the top, the top including a plurality of asymmetric downwardly extending teeth adjacent to the skirt, the teeth being adapted for asymmetric engagement with the base cap teeth, the skirt having a plurality of interspersed vertical legs each spaced apart from adjacent legs by vertical openings, the legs being joined by a support ring, the cover cap teeth being formed on an inner surface of the legs;

wherein when the cover cap is rotated in a first direction, the cover cap teeth positively engage the base cap teeth to cause the base cap to rotate along with the cover cap in the first direction;

wherein when the cover cap is rotated in a second direction in combination with a predetermined downward force urging the cover cap top toward the base cap top, the cover cap teeth positively engage the base cap teeth to cause the base cap to rotate along with the cover cap in the second direction, the base cap teeth each having a sloped sliding face to ensure that one of the cover cap teeth will drop into a notch between adjacent base cap teeth when the cover cap is rotated in the second direction;

wherein when the cover cap is rotated in the second direction in the absence of the predetermined downward force, the base cap remains nonrotating and the cover cap teeth slidably engage with the base cap teeth causing an audible clicking sound as pairs of teeth jump from one sliding engagement to another;

wherein each of the base cap teeth has an opening face on one side of the sliding face and each of the cover cap teeth has an opening face on one side of the sliding face; and wherein at least one of the base cap teeth opening faces and the cover cap teeth opening faces are sloped from vertical to enable the opening faces of the base cap teeth and cover cap teeth to slide over one another in the absence of the predetermined downward force.

2. The closure of claim 1, the base cap teeth being formed in an outer wall of the base cap skirt.

3. The closure of claim 1, the legs each further comprising an inwardly protruding raised ridge for centering the cover cap on the base cap.

4. The closure of claim 1, each of the base cap teeth further having a closing face on an opposite side of the sliding face from the opening face;

wherein the closing face has a slope in the range of vertical to about 20 degrees from vertical;

wherein the opening face has a slope in the range of about 20 degrees to about 45 degrees from vertical; and wherein the sliding face has a slope in the range of about 2 degrees to about 10 degrees from horizontal;

such that a junction between the closing face and the sliding face is disposed above a junction between the opening face and the sliding face.

5. The closure of claim 4, wherein the closing face has a slope of about 20 degrees from vertical;

wherein the opening face has a slope of about 30 degrees from vertical; and wherein the sliding face has a slope of about 6 degrees from vertical.

6. The closure of claim 4, wherein each of the closing face and the opening face is undercut with respect to the base cap skirt to enhance the engagement between the base cap teeth and the cover cap teeth.

7. The closure of claim 1, each of the cover cap teeth further having a closing face on an opposite side of the sliding face from the opening face;

wherein the closing face has a slope in the range of about vertical to about 10 degrees from vertical;

wherein the opening face has a slope in the range of about 35 degrees to about 55 degrees from vertical; and wherein the sliding face has a slope in the range of about horizontal to about 5 degrees from horizontal.

8. The closure of claim 7, wherein the closing face has a slope of about vertical;

wherein the opening face has a slope of about 45 degrees from vertical; and wherein the sliding face has a slope of about horizontal.

9. The closure of claim 7, wherein each of the closing face and the opening face is undercut with respect to the cover cap skirt to enhance the engagement between the cover cap teeth and the base cap teeth.

10. The closure of claim 1, the cover cap teeth each further including recessed rear notches for reducing the amount of material required to make the cover cap and for improving molding of the cover cap teeth.

11. The closure of claim 1, the cover cap top further comprising a centrally disposed opening for reducing the amount of material required to make the cover cap.

12. The closure of claim 1, the vertical openings in the cover cap being small enough to prevent a child's fingers from accessing and turning the base cap independently from the cover cap, and being configured to permit the audible clicking sound to emit from the closure.

13. The closure of claim 1, the support ring of the cover cap including a rim for engaging the bottom face of the base cap to inhibit removal of the cover cap from the base cap.

14. The closure of claim 13, the rim protruding radially inwardly from the cover cap skirt.

15. A child-resistant container closure comprising:

a base cap having a top and a skirt depending downwardly from the top, the skirt including a plurality of asymmetric teeth formed in an outer wall of the skirt and recessed below the top, internal threads for engaging a neck of the container, and a bottom end, each of the teeth having a closing face sloped about 20 degrees from vertical, an opening face sloped about 30 degrees from vertical, and a sliding face disposed between the closing face and the sliding face and sloped about 6 degrees from horizontal, a junction between the closing face and the sliding face being disposed above a junction between the opening face and the sliding face; and a cover cap having a top and a skirt depending downwardly from the top, the top including a plurality of asymmetrical downwardly extending teeth adapted for asymmetric engagement with the upwardly extending base cap teeth, the skirt having bottom end, an inwardly protruding raised ridge for centering the cover cap on the base cap, and a support ring protruding radially inwardly from the bottom end to engage with a ridge protruding radially outwardly from the bottom end of the base cap skirt to inhibit removal of the cover cap from the base cap, each of the cover cap teeth having a closing face sloped about vertical, an opening face sloped about 45 degrees from vertical, and a sliding face disposed between the closing face and the sliding face and sloped about horizontal;

wherein when the cover cap is rotated in a first direction, the cover cap teeth positively engage the base cap teeth to cause the base cap to rotate along with the cover cap in the first direction;

wherein when the cover cap is rotated in a second direction in combination with a predetermined downward force urging the cover cap top toward the base cap top, the cover cap teeth positively engage the base cap teeth to cause the base cap to rotate along with the cover cap in the second direction, the slope of the sliding faces of the base cap teeth ensuring that one of the cover cap teeth will drop into a notch between adjacent base cap teeth when the cover cap is rotated in the second direction; and wherein when the cover cap is rotated in the second direction in the absence of the predetermined downward force, base cap remains nonrotating and the cover cap teeth slidably engage with the base cap teeth causing an audible clicking sound as pairs of teeth jump from one sliding engagement to another.

16. The closure of claim 15, the cover cap skirt having a plurality of interspersed vertical legs each spaced apart from adjacent legs by vertical openings, the legs being joined by the support ring, the vertical openings in the cover cap being small enough to prevent a child's fingers from accessing and turning the base cap independently from the cover cap, and being configured to permit the audible clicking sound to emit from the closure.

17. The closure of claim 15, wherein each of the closing face and the opening face of the base cap teeth is undercut with respect to the base cap skirt and wherein each of the closing face and the opening face of the cover cap teeth is undercut with respect to the respect to the cover cap skirt to enhance the engagement between the cover cap teeth and the base cap teeth.

18. The closure of claim 15, the cover cap teeth each further including recessed rear notches for reducing the amount of material required to make the cover cap and for improving molding of the teeth.

19. The closure of claim 15, the cover cap top further comprising a centrally disposed opening for reducing the amount of material required to make the cover cap.

* * * * *